United States Patent [19]

Baum et al.

[11] Patent Number: 5,042,347

[45] Date of Patent: Aug. 27, 1991

[54] APPARATUS FOR GUIDING A TEXTILE WEB DURING TRIMMING OF SELVEDGE THEREFROM

[75] Inventors: Gottfried Baum, Erkelenz; Manfred Röntgen, Mönchengladbach, both of Fed. Rep. of Germany

[73] Assignee: A. Monforts GmbH & Co., Fed. Rep. of Germany

[21] Appl. No.: 419,762

[22] Filed: Oct. 11, 1989

[30] Foreign Application Priority Data

Oct. 11, 1988 [DE] Fed. Rep. of Germany ..... 3834571

[51] Int. Cl.[5] ..... B26D 7/06

[52] U.S. Cl. ..... 83/422; 83/423; 83/431; 83/435.2

[58] Field of Search ..... 83/100, 422, 423, 431, 83/435.2

[56] References Cited

U.S. PATENT DOCUMENTS

| | | | |
|---|---|---|---|
| 3,304,820 | 2/1967 | Müller et al. | 83/423 X |
| 4,046,043 | 9/1977 | Kistner et al. | 83/435.2 X |
| 4,669,347 | 6/1987 | Worner | 83/422 |
| 4,941,377 | 7/1990 | Ishihara et al. | 83/423 X |

FOREIGN PATENT DOCUMENTS

| | | |
|---|---|---|
| 1199730 | 9/1965 | Fed. Rep. of Germany . |
| 3500632C2 | 2/1987 | Fed. Rep. of Germany . |
| G8706248.8 | 8/1987 | Fed. Rep. of Germany . |

*Primary Examiner*—Timothy V. Eley
*Attorney, Agent, or Firm*—Shefte, Pinckney & Sawyer

[57] ABSTRACT

An apparatus for guiding a traveling web of textile material is provided for guiding a web traveling in an apparatus for trimming selvedge from the web. The web guiding apparatus includes a device for supporting the traveling web during the feed of the web from a web conveying assembly to a severing location at which a selvedge is severed from the web. The support device includes an endless belt assembly having an endless belt traveling in an inclined direction with respect to the web travel path of the web conveying assembly. The web guiding apparatus further includes a support bar for supporting the web laterally inwardly of the endless belt.

4 Claims, 1 Drawing Sheet

APPARATUS FOR GUIDING A TEXTILE WEB DURING TRIMMING OF SELVEDGE THEREFROM

BACKGROUND OF THE INVENTION

The present invention relates to an apparatus for guiding a traveling web of textile material during trimming of selvedge therefrom.

One known apparatus for trimming selvedge from a traveling web of textile material includes a web conveying assembly for conveying the web along a generally horizontal travel path and a rotating pin member having a plurality of radially outwardly extending pins for engaging the traveling web to feed it to a cutting device positioned upwardly from the original travel path of the web. To facilitate the impaling of the web on the pins of the rotating pin member, it is known to provide a nip roller disposed relative to the rotating pin member to define a nip therebetween in which the web is moved into engagement with the rotating pin member.

One apparatus which includes a nip roller is disclosed, for example, in German Auslegeschrift 11 99 730. However, such apparatus are susceptible to the risk that the web will move out of engagement with the web conveying assembly before it is engaged by the rotating pin member. Remedial action is then required including, for example, manually guiding the displaced web to the nip between the rotating pin member and the nip roller. One solution for this problem which has been proposed includes substituting a plate-type member for the nip roller, the plate-type member extending over a relatively long extent such as, for example, about 30 centimeters, along the underside of the traveling web. While the plate-type member can be beneficial in urging the traveling web back into position for engagement by the rotating pin member, experience has shown that manual remedial handling of the traveling web is often times still required.

Accordingly, the need exists for an apparatus for automatically guiding a traveling web into engagement with a rotating pin member for feed of the web to a selvedge trimming device that is reliable in operating properly without significant occurrences of mishandling of the web.

SUMMARY OF THE INVENTION

The present invention provides an apparatus for automatically guiding a traveling web into engagement with a rotating pin member for feed of the web to a selvedge trimming device in a manner that is consistently reliable in operating without significant occurrences of mishandling of the web.

Briefly described, the present invention provides a web guiding means for use in an apparatus for trimming selvedge from a traveling web of a textile material having a web conveying assembly for conveying the web along a travel path, a device for severing the selvedge from the body of the traveling web at a severing location displaced relative to the web travel path of the conveying assembly and a device for feeding the traveling web from the web conveying assembly to the severing device for severing of the selvedge. The web guiding apparatus includes means for supporting the traveling web during feeding thereof from the web conveying assembly to the severing location, the supporting means including an endless belt assembly having an endless belt traveling in an inclined direction with respect to the web travel path of the web conveying assembly for guiding the web into engagement with the device for feeding the web from the web conveying assembly to the severing device.

In the preferred embodiment, the apparatus of the present invention includes an endless belt for use in an apparatus for trimming selvedge having a generally horizontal web travel path of the web conveying assembly and a severing location displaced upwardly relative to the travel path of the web conveying assembly and a device for feeding the traveling web from the web conveying assembly to the severing device includes a rotating web feeding member having a plurality of pins extending radially outwardly along an arcuate portion thereof and a pair of axially spaced disks, the pin member being rotatably mounted between the disks for rotation about an axis eccentric to the axis of the disks. The endless belt is oriented relative to the rotating web feeding member for guiding the web from the web conveying assembly into engagement with the pins of the rotating web feeding member.

In the preferred embodiment, the apparatus of the present invention includes an endless belt assembly for use in an apparatus for trimming selvedge having a severing device which includes a rotating member having a circumferential web cutting edge rotating in adjacently overlapping relation with the disks of the device for feeding the traveling web, the endless belt assembly of the web guiding apparatus includes a lower guide roller and an upper guide roller around and between which the endless belt is trained, the lower guide roller being positioned relative to the web conveying assembly for supporting the endless belt generally at the interface between the rotating web feeding member and the web conveying assembly and the upper roller being positioned relative to the severing location for supporting the endless belt generally at the overlap between the disk members and the rotating cutting member.

The web guiding apparatus preferably includes a support member faced inwardly from the endless belt relative to the traveling web, for supporting the traveling web during guiding of the web by the endless belt. The support member includes an elongate bar extending at generally the same inclined direction as the endless belt and the ends of the bar are oriented outwardly relative to the traveling web.

DETAILED DESCRIPTION OF THE PREFERRED EMBODIMENT

Figure 1:
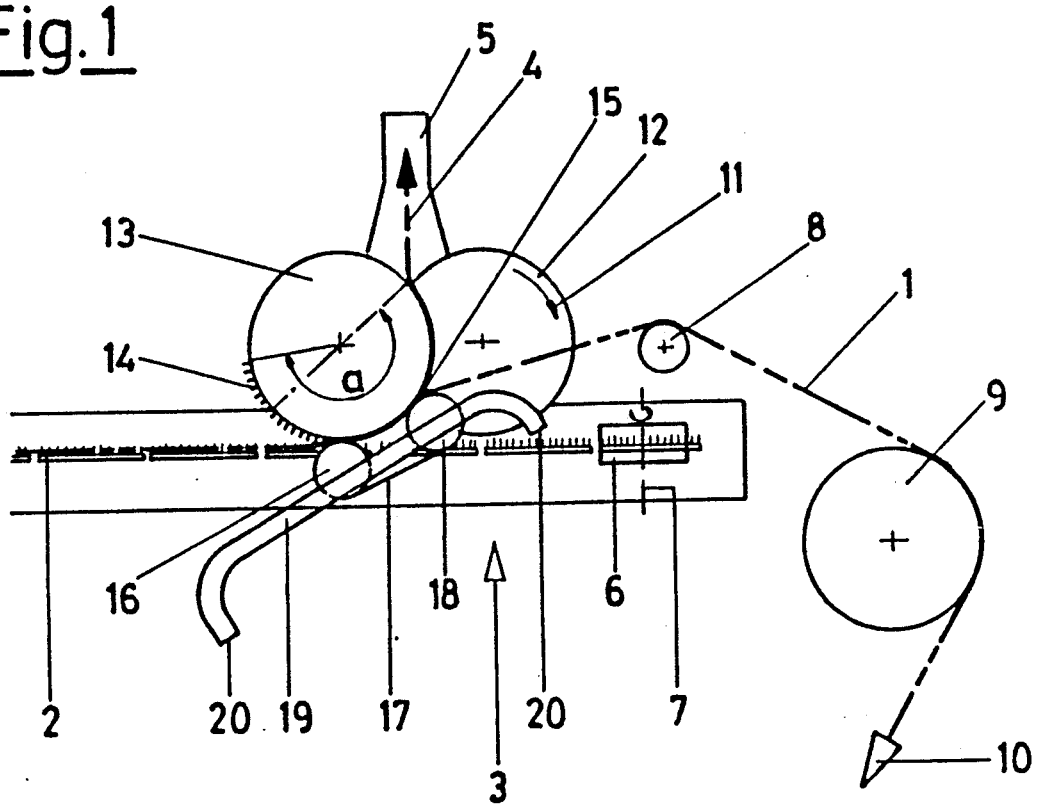
FIG. 1 is a side elevational view of an apparatus for trimming selvedge including a web guiding means according to the preferred embodiment of the present invention.
Figure 2:
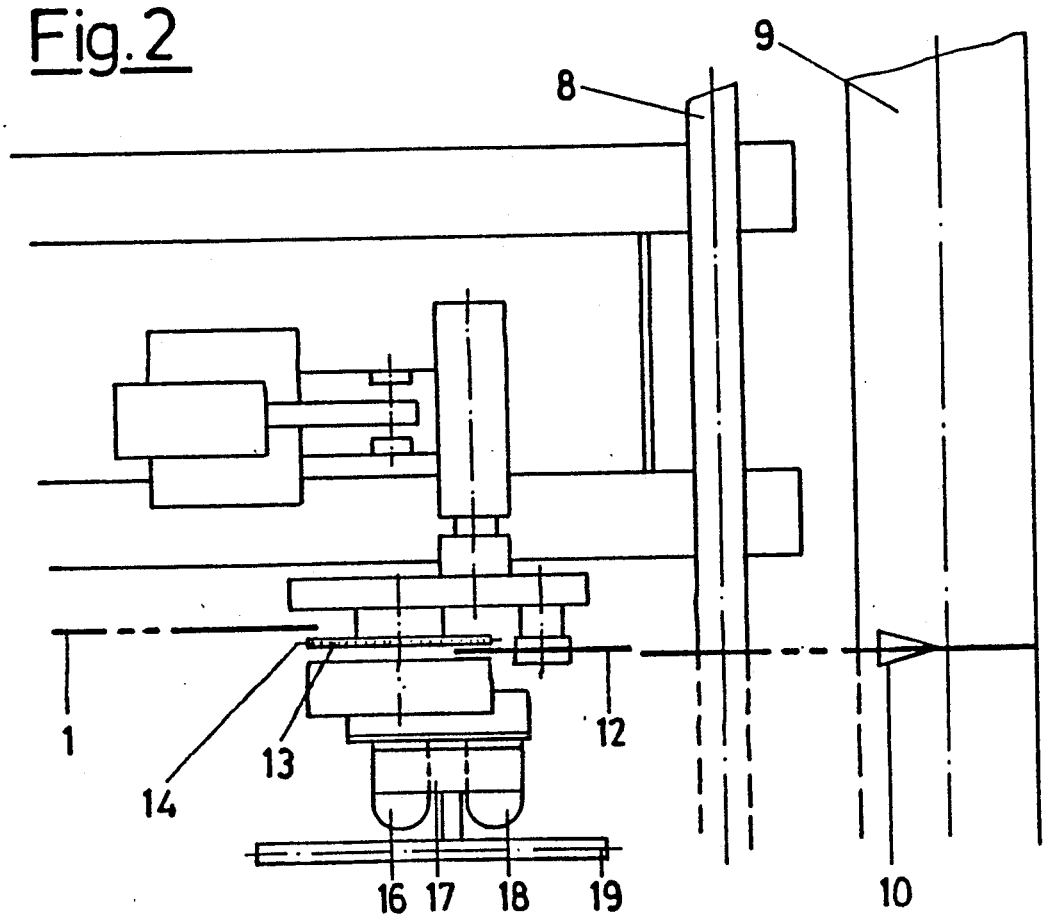
FIG. 2 is a plan view of the apparatus of FIG. 1.

FIGS. 1 and 2 illustrate an apparatus for trimming selvedge wherein a web of textile material is conveyed along a travel path by a conventional web conveying assembly which, in the illustrated form includes a pair of endless chain assemblies 2 (only one of which is shown). Each endless chain assembly 2 includes an endless chain traveling in a plane parallel to the plane of the movement of the traveling web and includes a plurality of vertical pins for engaging the web at the selvedge adjacent its edge portion for conveying of the web in a laterally extended condition in a generally horizontal travel path. The endless chain of each assembly 2 is trained around a conventional guide roller 6 which rotates about a vertical axis of rotation 7 to train the chain in a return path. A selvedge trimming apparatus is disposed near the end of the run of each endless chain for trimming selvedge 4 from the web 1. The selvedge trimming apparatus includes a device 12 for severing the selvedge from the body of the traveling web 1 at a severing location 15 displaced upwardly relative to the travel path of the web, a device 13 for feeding the traveling web from the web conveying assembly to the severing device 12 and a selvedge removal device 5 for removing the severed selvedge 4.

Once the selvedge 4 has been severed from the web 1, the web is conveyed over a guide roller 8 by a conventional take-off roller 9 positioned downstream of the severing location 15 and the web is driven in the direction indicated by the arrow 10 to a location for further handling or storage.

The feeding device 13 is conventional and includes a pair of coaxial, axially spaced disks and a web feeding pin member or wheel 14 rotatably mounted between the disks for rotation about an axis eccentric to the axis of the disks. The rotating pin wheel 14 includes a plurality of radially outwardly extending pins along an arcuate portion "a" of its circumference. As can be understood, the pins of the rotating pin wheel 14 extend radially outwardly beyond the circumference of the disks during a portion of their rotational travel and are recessed inwardly from the circumference of the disks during the remainder of the rotation of the rotating pin member. The pins of the rotating pin wheel 14 are adapted to engage the web 1 to feed the web from the web conveying assembly 2 to the severing location 15 for severing of the selvedge 4 by the severing device 12. To this end, the severing device 12 is conventionally constructed as a rotating disk having a circumferential cutting edge. The severing device 12 is disposed relative to the feeding device 13 such that a portion of the rotational travel path of the cutting edge is in adjacently overlapping relation to the feeding device 13 as viewed in the axial direction of the disks of the feeding device 13.

In operation, the web conveying assembly 2 operates in conjunction with the other web conveying assembly to convey the web 1 along a travel path. The rotating pin wheel 14 is rotated to bring its pins into engagement with the web 1 to feed the web upwardly relative to the travel path into the severing location 15. Due to the relation of the feeding device 13 and the severing device 12, the circumferential cutting edge of the severing device 12 continuously rotates into trimming engagement with the upwardly moving web to thereby sever the selvedge 4 from the web. The severed selvedge 4 is removed conventionally by suction or other appropriate means by the selvedge removal device 5.

In accordance with the present invention, a web guiding apparatus is provided and includes a means for supporting a traveling web 1 during the feed thereof from the web conveying assembly 2 to the severing location 15. The supporting means includes an endless belt assembly having an endless belt 17 trained around a lower guide roller 16 and an upper guide roller 18 for travel of the endless belt in an inclined direction with respect to the web travel path of the web conveying assembly. One of the rollers 16, 18 is conventionally driven to drive the endless belt 17. The lower guide roller 16 is positioned relative to the web conveying assembly 2 and the feeding device 13 for supporting the endless belt 17 generally at the location of the initial engagement of the web 1 by the pins of the rotating pin wheel 14. The upper guide roller 18 is positioned relative to the severing location 15 for supporting the endless belt 17 generally at the severing location. Accordingly, the endless belt 17 is driven about the lower guide roller 16 and the upper guide roller 18 for supporting the web 1 during its feed from the web conveying assembly 2 to the severing location 15. The supporting means thus reduces the risk that the web 1 will prematurely disengage from the web conveying assembly 2—i.e., before engagement of the web 1 by the rotating pin wheel 14 and before the selvedge is cut.

The supporting means additionally includes a support member 19 in the form of an elongate bar laterally inwardly of the guide rollers 16, 18 and having a portion extending in the web travel path laterally inwardly of the selvedge at generally the same inclination as the endless belt 17 for supporting the web 1. The support member 19 has ends 20 oriented in a direction downwardly away from the web travel path to avoid interference with the web. The bar 19 extends from an upstream location upstream and below the lower guide roller 16 to a downstream location downstream of the upper guide roller 18. The bar is fixedly mounted by appropriate conventional mounting means (not shown) to the machine.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In an apparatus for trimming selvedge from a traveling web of a textile material having a web conveying assembly for conveying the web along a travel path, a device for severing the selvedge from the body of the traveling web at a severing location displaced upwardly relative to the web travel path of the conveying assembly and a device for feeding the traveling web from the web conveying assembly to the severing device for severing of the selvedge including a rotating web feeding member having a plurality of pins extending radially outwardly along an arcuate portion thereof and a pair of axially spaced disks, the web feeding member being rotatably mounted between the disks for rotation about an axis eccentric to the axis of the disks and the severing device including a rotating member having a circumferential web cutting edge rotating in adjacently overlapping relation with the disks of the device for feeding the traveling web, a web guiding means comprising:

means for supporting the traveling web during feeding thereof from the web conveying assembly to the severing location, said supporting means including an endless belt assembled having an endless belt traveling in an inclined direction with respect to the web travel path of the conveying assembly for guiding the web into engagement with the device for feeding the web from the web conveying assembly to the severing device, said endless belt assembly including a lower guide roller and an upper guide roller around and between which said endless belt is trained, said lower guide roller being positioned relative to the web conveying assembly for supporting said endless belt for guiding the web generally at the location of initial engagement of the traveling web by the rotating web feeding member and said upper roller being positioned relative to the severing location for supporting said endless belt for guiding the web generally at the overlap between the disks and the rotating cutting member.

2. In an apparatus for trimming selvedge, a web guiding means according to claim 1 and characterized by a support member, spaced laterally inwardly from said endless belt relative to the selvedge of the traveling web, for supporting the traveling web during guiding of the web by said endless belt.

3. In an apparatus for trimming selvedge, a web guiding means according to claim 2 and characterized further in that said support member includes an elongate bar having a portion extending at generally the same inclined direction as said endless belt for supporting the traveling web.

4. In an apparatus for trimming selvedge, a web guiding means according to claim 3 and characterized further in that said bar has ends oriented downwardly away from the traveling web.

* * * * *